US009481920B2

(12) United States Patent
Hori et al.

(10) Patent No.: US 9,481,920 B2
(45) Date of Patent: *Nov. 1, 2016

(54) ALUMINIUM ALLOY FORGING AND METHOD OF MANUFACTURE FOR SAME

(75) Inventors: Masayuki Hori, Inabe (JP); Yoshiya Inagaki, Inabe (JP)

(73) Assignee: Kobe Steel, Ltd., Kobe-shi (JP)

( * ) Notice: Subject to any disclaimer, the term of this patent is extended or adjusted under 35 U.S.C. 154(b) by 840 days.

This patent is subject to a terminal disclaimer.

(21) Appl. No.: 13/634,731

(22) PCT Filed: Mar. 8, 2011

(86) PCT No.: PCT/JP2011/055346

§ 371 (c)(1),
(2), (4) Date: Sep. 13, 2012

(87) PCT Pub. No.: WO2011/122263

PCT Pub. Date: Oct. 6, 2011

(65) Prior Publication Data

US 2013/0032255 A1 Feb. 7, 2013

(30) Foreign Application Priority Data

Mar. 31, 2010 (JP) ..... 2010-084222

(51) Int. Cl.
*C22C 21/08* (2006.01)
*C22F 1/05* (2006.01)
(Continued)

(52) U.S. Cl.
CPC ..... *C22C 21/02* (2013.01); *B21J 1/06* (2013.01); *B21K 1/74* (2013.01); *B22D 21/007* (2013.01); *C22C 21/06* (2013.01); *C22C 21/08* (2013.01); *C22F 1/00* (2013.01); *C22F 1/05* (2013.01)

(58) Field of Classification Search
CPC ..... C22C 21/08; C22F 1/05
See application file for complete search history.

(56) References Cited

U.S. PATENT DOCUMENTS 6,630,037 B1 10/2003 Sawada et al.
2005/0086784 A1 4/2005 Li et al.
(Continued)

FOREIGN PATENT DOCUMENTS

EP 0 987 344 A1 3/2000
EP 2 003 219 A2 12/2008
(Continued)

OTHER PUBLICATIONS

Extended European Search Report issued Nov. 26, 2015 in Patent Application No. 11762503.8.

*Primary Examiner* — Roy King
*Assistant Examiner* — Janelle Morillo
(74) *Attorney, Agent, or Firm* — Oblon, McClelland, Maier & Neustadt, L.L.P.

(57) ABSTRACT

Disclosed is an aluminum alloy forging for use in automotive suspension parts and the like, and a method of manufacture for same. The aluminum alloy forging contains Si 0.4-1.5 wt %, Fe greater than 0.4 wt % and equal to or less than 1.0 wt %, Cu equal to or less than 0.40 wt %, Mg 0.8-1.3 wt % and Ti 0.01-0.1 wt %; Zn is restricted to equal to or less than 0.05 wt %; and the aluminum alloy forging contains at least one selected from among the following group comprising: Mn 0.01-1.0 wt % and Cr 0.1-0.4%; and Zr 0.05-0.2 wt %. Hydrogen content is restricted to 0.25 ml or less per 100 g of Al, and the remainder is composed of unavoidable impurities and Al. The average grain size is 50 μm or less, the crystallized area ratio is 3% or less, and the average crystallized grain size is 8 μm or less.

10 Claims, 3 Drawing Sheets

(51) Int. Cl.

| | |
|---|---|
| ***C22C 21/02*** | (2006.01) |
| ***B21J 1/06*** | (2006.01) |
| ***B21K 1/74*** | (2006.01) |
| ***C22F 1/00*** | (2006.01) |
| ***C22C 21/06*** | (2006.01) |
| ***B22D 21/00*** | (2006.01) |

(56) References Cited

U.S. PATENT DOCUMENTS

| | | | | |
|---|---|---|---|---|
| 2009/0000705 | A1 | 1/2009 | Nakai et al. | |
| 2010/0089503 | A1* | 4/2010 | Inagaki et al. | 148/550 |

FOREIGN PATENT DOCUMENTS

| | | | |
|---|---|---|---|
| JP | 6 256880 | | 9/1994 |
| JP | 2000 144296 | | 5/2000 |
| JP | 2001 107168 | | 4/2001 |
| JP | 2002 60881 | | 2/2002 |
| JP | 2002-294383 | A | 10/2002 |
| JP | 2003-277868 | A | 10/2003 |
| JP | 2007 169699 | | 7/2007 |
| JP | 2008-163445 | A | 7/2008 |
| WO | WO 2005/100623 | A2 | 10/2005 |
| WO | 2007 114078 | | 10/2007 |

* cited by examiner

ALUMINIUM ALLOY FORGING AND METHOD OF MANUFACTURE FOR SAME

TECHNICAL FIELD

The present invention relates to an aluminium alloy forging and method of manufacture for the same used as an automotive suspension part.

BACKGROUND ART

Various aluminium alloy forgings for use as automotive suspension parts such as upper arms and lower arms have been conventionally developed.

For example, patent document 1 describes an automotive suspension part consisting of an aluminium alloy forging comprising: Mg: 0.5 to 1.25% by mass, Si: 0.4 to 1.4% by mass, Cu: 0.01 to 0.7% by mass, Fe: 0.05 to 0.4% by mass, Mn: 0.001 to 1.0% by mass, Cr: 0.01 to 0.35% by mass, Ti: 0.005 to 0.1% by mass, Zr being restricted to less than 0.15% by mass, the remainder being Al and inevitable impurities, wherein in the structure in a cross section in the widthwise direction in a portion where the maximum stress is generated, the density of crystallized grains observed in the structure in the cross section portion where the maximum stress is generated is 1.5% or lower at an average area ratio, and the interval between grain boundary precipitates observed in the structure in the cross section portion including the parting line occurring during forging is 0.7 μm or more at an average interval.

In addition, this patent document 1 describes that the size of dispersed particles observed in the structured in a cross section portion where the maximum stress is generated is 1200 Å or lower at an average diameter, and the density of these dispersed particles is 4% or higher at an average area ratio, the percentage area occupied by recrystallized grains observed in cross sectional structures of these ribs is 10% or lower at an average area ratio, and further the percentage area occupied by recrystallized grains observed in cross-sectional structures in the width direction of webs adjacent to cross-sectional structures of these ribs is 20% or lower at an average area ratio.

In addition, this patent document 1 describes a method for manufacturing an automotive suspension part comprising casting an aluminium alloy molten metal having the above-mentioned predetermined composition at an average cooling rate of 100° C./s. or higher, heating this cast ingot to a temperature range from 460 to 570° C. at a programming rate of 10 to 1500° C./hr., performing a homogenizing heat treatment in which the ingot is retained within this temperature range for 2 hours or longer and then cooling the ingot to room temperature at a cooling rate of 40° C./hr. or higher, and further re-heating the ingot to hot-forging initiation temperature to perform hot-mold forging, the forging end temperature being 350° C. or higher, performing a solution treatment for retaining the ingot for 20 minutes to 8 hours in a temperature range from 530 to 570° C. after this hot-forging, then performing a hardening process at an average cooling rate ranging from 200 to 300° C./s., and further performing artificial age hardening.

According to the invention described in this patent document 1, a forged automotive suspension part having a light-weight configuration achieving high strength, tenacity and corrosion resistance can be realized.

PRIOR ART DOCUMENT

Patent Document

Patent document 1: Japanese Unexamined Patent Publication No. 2008-163445

DISCLOSURE OF INVENTION

Problems to be Solved by the Invention

It is known that in aluminium alloy used for automobile suspension parts and the like intermetallic compounds are formed by impurities such as Fe, Si and Ti, which adversely affect various characteristics. When the amount of Fe contained is high, Al—Fe—Si-based intermetallic compounds are likely to be formed as crystals. The crystallization shape of these crystallized grains is likely to be acicular, and the crystallized grains are characteristically hard and brittle. Therefore, they adversely affect the anti-fracture toughness and fatigue characteristics of the aluminium alloy.

In the invention described in the above-mentioned patent document 1, the amount of Fe contained is limited to 0.4% by mass or lower, and there has been the problem that when the amount of Fe contained is higher than 0.4% by mass, crystallized grains (Al—Fe—Si-based intermetallic compounds) are coarsened. In contrast, the inventors of the present invention have found that when the crystallized grains are coarsened and an average crystallized grain size is greater than 8 μm, anti-fracture toughness and fatigue characteristics tend to be lowered.

The present invention has been made in view of the above-mentioned problem. An object of the present invention is to provide an aluminium alloy forging which has as high anti-fracture toughness and fatigue characteristics as an aluminium alloy forging having a Fe content of 0.4% by mass or lower even when the amount of Fe contained is higher than 0.4% by mass, and a method of manufacture for the same.

Means for Solving the Problems

The aluminium alloy forging according to the present invention comprises: Si: not less than 0.4% by mass but not more than 1.5% by mass, Fe: more than 0.4% by mass but not more than 1.0% by mass, Cu: not more than 0.40% by mass, Mg: not less than 0.8% by mass but not more than 1.3% by mass, Ti: not less than 0.01% by mass but not more than 0.1% by mass, Zn being restricted to not more than 0.05%, further comprising at least one member selected from Mn: not less than 0.01% by mass but not more than 1.0% by mass, Cr: not less than 0.1% by mass but not more than 0.4% by mass, and Zr: not less than 0.05% by mass but not more than 0.2% by mass, and the amount of hydrogen being restricted to not more than 0.25 ml/100 g Al, with the remainder being inevitable impurities and Al, the aluminium alloy forging having an average grain size of 50 μm or lower, a crystallized area ratio of 3% or lower, and an average crystallized grain size of 8 μm or lower.

In the aluminium alloy forging according to the present invention, Si, Cu and Mg are contained in the aforementioned ranges, whereby the strength required, for example, for an automotive suspension part can be obtained. By containing Ti in the aforementioned range, the cast structure can be refined. Moreover, by containing Mn, Cr and Zr in the aforementioned range, recrystallization during solutionizing can be suppressed, and fine crystals can be produced.

Accordingly, fatigue characteristics can be ensured. In addition, by causing the amount of hydrogen to fall within such a range, pin holes and blistering can be suppressed, and not only fracture toughness and fatigue characteristics but also strength, elongation and various other characteristics can be ensured. In addition, in the present invention, by adding Fe in such a large amount, and conducting a heating step under specific conditions before forging as described later, reduction, refinement, and rounding of crystallized grains containing Fe, as well as refinement of crystal grains, are achieved. Corrosion resistance, anti-fracture toughness, and fatigue characteristics are ensured by controlling the average grain size, crystallized area ratio, and average crystallized grain size to have specific values or lower values.

The method for manufacturing the aluminium alloy forging according to the present invention is a method for manufacturing the above-mentioned aluminium alloy forging, the method comprising a casting step for casting, at a heating temperature of 710 to 810° C. and at a casting rate of 200 to 330 mm/min., an ingot of an aluminium alloy containing Si: not less than 0.4% by mass but not more than 1.5% by mass, Fe: more than 0.4% by mass but not more than 1.0% by mass, Cu: not more than 0.40% by mass, Mg: not less than 0.8% by mass but not more than 1.3% by mass, Ti: not less than 0.01% by mass but not more than 0.1% by mass, Zn being restricted to not more than 0.05%, the aluminium alloy further comprising at least one member selected from the group consisting of Mn: not less than 0.01% by mass but not more than 1.0% by mass, Cr: not less than 0.1% by mass but not more than 0.4% by mass, and Zr: not less than 0.05% by mass but not more than 0.2% by mass, and the amount of hydrogen being restricted to not more than 0.25 ml/100 g Al, with the remainder being unavoidable impurities and Al, a homogenizing heat treatment step for subjecting the ingot to a homogenizing heat treatment at 420 to 560° C. for 2.5 to 8 hours, a heating step for heating the ingot which has been subjected to the homogenizing heat treatment at 470 to 545° C. for 0.5 hours or longer, a forging step for forging the heated ingot at a temperature of 330° C. or higher and at a draft of 50 to 95% after completion of forging to obtain a forging a predetermined shape, a solution treatment step for subjecting the forging to a solution treatment at 480 to 580° C. for longer than 0 hours but not longer than 24 hours, a hardening step for hardening the forging which has been subjected to the solution treatment at 75° C. or lower, an artificial aging step for subjecting the hardened forging at 160 to 250° C. for 0.5 to 20 hours to artificial aging.

In the present invention, by performing a heating step under specific conditions before performing forging using an ingot of aluminium alloy having the above-mentioned composition, the ingot is sufficiently heated, and a reduction, refinement, and rounding of crystallized grains containing Fe, as well as refinement of crystal grains, can be achieved. Accordingly, the average grain size, crystallized area ratio, and average crystallized grain size are controlled to have specific values or lower values, whereby corrosion resistance, anti-fracture toughness and fatigue characteristics are ensured. In addition, the strength required, for example, for an automotive suspension part is ensured by the solution treatment, hardening, and artificial aging treatment after forging.

Effect of the Invention

In the aluminium alloy forging according to the present invention, the amount of Fe contained is higher than 0.4% by mass. However, coarsening of the crystallized grains and crystal grains is suppressed, and the crystallized area ratio is also suppressed. Therefore, the aluminium alloy forging of the present invention has as high anti-fracture toughness and fatigue characteristics as an aluminium alloy forging having a Fe content of 0.4% by mass or lower. In addition, it can contain Fe in an amount up to 1.0% by mass, and therefore the percentage addition of base metal recycled from scrap can be increased, and virgin metal with low purity can also be used.

According to the method for manufacturing an aluminium alloy forging of the present invention, although the amount of Fe contained is higher than 0.4% by mass, an aluminium alloy forging with suppressed coarsening of crystallized grains and crystal grains and a restricted crystallized area ratio can be manufactured.

Accordingly, it is possible to impart as high anti-fracture toughness and fatigue characteristics as an aluminium alloy forging having a Fe content of 0.4% by mass or lower to the aluminium alloy forging manufactured by such a manufacturing method. In addition, the percentage addition of base metal recycled from scrap can be increased, and virgin metal with low purity can also be used.

In addition, according to the method for manufacturing an aluminium alloy forging of the present invention, since the aluminium alloy forging contains a large amount of Fe, shrinkage cracks are unlikely to occur. Accordingly, casting rate can be increased.

EXPLANATION OF REFERENCES

Figure 1:
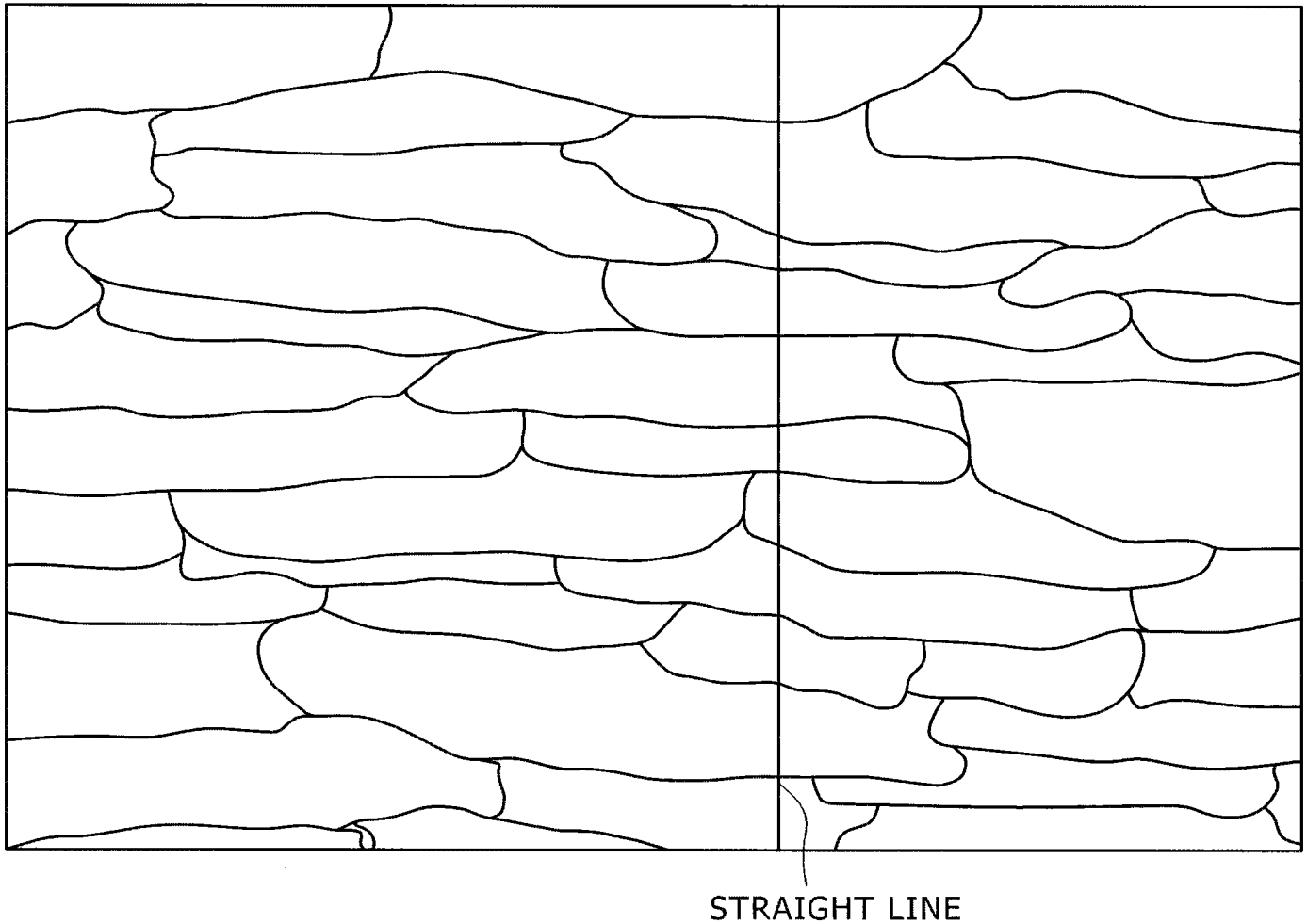
FIG. 1 is a schematic diagram which illustrates a measurement method of the average grain size.

1 Automotive suspension part
2*a*, 2*b* Arm portions
3*a*, 3*b*, 3*c* Ribs
4*a*, 4*b* Webs
5*a*, 5*b*, 5*c* Joint portions
S1 Casting step
S2 Homogenizing heat treatment step
S3 Heating step
S4 Forging step
S5 Solution treatment step
S6 Hardening step
S7 Artificial aging step

BEST MODE FOR CARRYING OUT THE INVENTION

The aluminium alloy forging and method of manufacture for the same according to the present invention will be described in detail below.

First, the aluminium alloy forging according to the present invention will be described.

The aluminium alloy forging according to the present invention comprises: Si: not less than 0.4% by mass but not more than 1.5% by mass, Fe: more than 0.4% by mass but not more than 1.0% by mass, Cu: not more than 0.40% by mass, Mg: not less than 0.8% by mass but not more than 1.3% by mass, Ti: not less than 0.01% by mass but not more than 0.1% by mass, Zn being restricted to not more than 0.05%, further comprising at least one member selected from the group consisting of Mn: not less than 0.01% by mass but not more than 1.0% by mass, Cr: not less than 0.1% by mass but not more than 0.4% by mass, and Zr: not less than 0.05% by mass but not more than 0.2% by mass, the amount of hydrogen being restricted to not more than 0.25 ml/100 g Al, with the remainder being inevitable impurities and Al, and the aluminium alloy forging having an average grain size of 50 μm or lower, a crystallized area ratio of 3% or lower, and an average crystallized grain size 8 μm or lower.

Each of the components will be separately described below.

(Si: Not Less than 0.4% by Mass but not More than 1.5% by Mass)

Si is, as well as Mg, an essential element which is deposited in crystal grains by the artificial aging treatment mainly as an acicular β" phase, and contributes to achieving high strength (yield strength). When the amount of Si contained is too low, crystal grains are coarsened and sufficient strength (tensile strength and 0.2% yield strength) and fatigue characteristics cannot be obtained by the artificial aging treatment. In contrast, when the amount of Si contained is too high, coarse particles of pure Si are crystallized out and deposited in the course of hardening during continuous casting and after solution treatment, and corrosion resistance and anti-fracture toughness are lowered. In addition, an excessive amount of Si prevents obtaining high corrosion resistance and high anti-fracture toughness. Furthermore, other processabilities such as lowered elongation are also suppressed. Therefore, the amount of Si contained is to be not less than 0.4% by mass but not more than 1.5% by mass, and preferably not less than 0.6% but not more than 1.0% by mass.

(Fe: More than 0.4% by Mass but not More than 1.0% by Mass)

Fe, as well as Mn and Cr, produces dispersed particles (dispersion phase) to prevent grain boundary migration after recrystallization, prevents coarsening of crystal grains, and refines crystal grains.

Herein, in the case of a known aluminium alloy forging having a Fe content of 0.4% by mass or lower, solution of dispersion particles also proceeds when it is heat-treated at a high temperature, and therefore crystal grains are likely to be coarsened by recrystallization.

When a large amount of Fe is contained as in the present invention, the density of dispersed particles is increased, and therefore recrystallization can be suppressed even when it is heated at a high temperature. In addition, as will be described later, by sufficiently heating the ingot in this heating step before performing the forging step as in the present invention, Fe-based crystallized grains can be dissolved and decreased, and can be further refined and rounded. Accordingly, the density of dispersed particles can be as high as in a known material. The heating step will be described later in detail.

When the amount of Fe contained is too low, such effects are absent. In contrast, when the amount of Fe contained is too high, crystallized grains such as Al—Fe—Si-based intermetallic compounds are coarsened. The coarsened crystallized grains deteriorate anti-fracture toughness, fatigue characteristics, corrosion resistance and other properties. In addition, lowered anti-fracture toughness also lowers elongation. Therefore, the amount of Fe contained is to be more than 0.4% by mass but not more than 1.0% by mass, and preferably more than 0.4% by mass but not more than 0.7% by mass.

(Cu: Not More than 0.40% by Mass)

Cu contributes to improvement of strength by enhancing solution, and also functions to significantly promote the age hardening of a final product in aging treatment. However, when the amount of Cu contained is too high, the sensitivity of the Al alloy forging to the stress corrosion crack and grain boundary corrosion is significantly increased, and the corrosion resistance and durability of the Al alloy forging are lowered. Therefore, the amount of Cu contained is to be not more than 0.40% by mass, preferably not less than 0.10% by mass, more preferably not less than 0.2% by mass but not more than 0.4% by mass, and still more preferably not less than 0.2% by mass but not more than 0.3% by mass.

(Mg: Not Less than 0.8% by Mass but not More than 1.3% by Mass)

Mg, as well as Si, is deposited in crystal grains by the artificial aging treatment mainly as an acicular β" phase, and is an essential element which contributes to achieving high strength (yield strength) of an automotive suspension part. When the amount of Mg contained is too low, the amount of age hardening during the artificial aging treatment is lowered. Moreover, recrystallization is more likely to occur, which likely causes coarsening of crystal grains. Corrosion resistance is also lowered by pure Si which was not able to form $Mg_2Si$. In contrast, when the amount of Mg contained is too high, crystallized grains are likely to be formed, and further strength (yield strength) gets too high, which inhibit forgeability. In addition, a large amount of $Mg_2Si$ which does not contribute to improvement in the strength is deposited in the course of hardening after the solution treatment, and strength, anti-fracture toughness, corrosion resistance and other properties are lowered on the contrary. Therefore, the amount of Mg contained is to be not less than 0.8% by mass but not more than 1.3% by mass, preferably not less than 0.85% by mass but not more than 1.2% by mass, and more preferably not less than 1.0% by mass but not more than 1.2% by mass.

(Ti: Not Less than 0.01% by Mass but not More than 0.1% by Mass)

Ti functions to refine crystal grains in the ingot. When the amount of Ti contained is too low, this effect is not exhibited. In addition, crystal grains are coarsened, and the strength is lowered. As a result, the fatigue strength is also lowered. However, when the amount of Ti contained is too high, coarse crystallized grains are formed, and the anti-fracture toughness is lowered. The coarse crystallized grains serve as starting points of destruction, and fatigue characteristics are lowered. Therefore, the amount of Ti contained is to be not less than 0.01% by mass but not more than 0.1% by mass, and preferably not less than 0.01% by mass but not more than 0.05% by mass.

(Zn: Restricted to not More than 0.05% by Mass)

It is preferable that Zn, which is often contained as an impurity, is not contained since it inhibits the characteristics of an automotive suspension part, but Zn in an amount not more than 0.05% by mass is allowed since it does not inhibit the characteristics of the automotive suspension part. However, when the amount of Zn contained is more than 0.05% by mass, the anti-fracture toughness, corrosion resistance, elongation and fatigue characteristics are lowered.

It should be noted that the amount of Zn is restricted to not more than 0.05% by mass, when, for example, virgin metal is used or recycled base metal is used. When the amount of Zn contained in the recycled base metal is not more than 0.05% by mass, the virgin metal and recycled base metal can be used as they are, but when recycled base metal in which the amount of Zn contained is more than 0.05% by mass is used, it may be used after being mixed with virgin metal having a Zn content of not more than 0.05% by mass to make the content of Zn be not more than 0.05% by mass.

(Containing at Least One Member Selected from the Group Consisting of Mn: Not Less than 0.01% by Mass but not More than 1.0% by Mass, Cr: Not Less than 0.1% by Mass but not More than 0.4% by Mass, and Zr: Not Less than 0.05% by Mass not More than 0.2% by Mass)

Among these, Mn and Cr produce dispersed particles (dispersion phase) composed of Al—Mn-based and Al—Cr-based intermetallic compounds formed by selective coupling of Fe, Mn, Cr, Si, Al and other elements depending on their amounts contained, during the homogenizing heat treatment and during the hot-forging thereafter. Examples of such dispersed particles (dispersion phase) include Al—(Fe, Mn, Cr)-silicide, $(Fe, Mn, Cr)_3SiAl_{12}$, among others.

Although depending on the production conditions, these dispersed particles composed of Mn and Cr are fine, dense and uniformly dispersed which prevents grain boundary migration after recrystallization. Accordingly, crystal grains can maintain their fine state by preventing coarsening of crystal grains.

When the amounts of Mn and Cr are too low, these effects cannot be expected, and crystal grains are coarsened, which lowers the strength the anti-fracture toughness. In contrast, containment of these elements in excessive amounts tends to allow formation of coarse crystallized grains which are intermetallic compounds during dissolution and casting. These products serve as starting points of destruction and become a cause of lowered anti-fracture toughness fatigue characteristics. It should be noted that since anti-fracture toughness is proportionally related to elongation, elongation is also lowered. Therefore, at least one of Mn and Cr is to be contained, and the amount of Mn contained is to be not less than 0.01% by mass but not more than 1.0% by mass, preferably not less than 0.1% by mass but not more than 0.3% by mass, and the amount of Cr contained is to be not less than 0.1% by mass but not more than 0.4% by mass, preferably not less than 0.10% by mass not more than 0.3% by mass, and more preferably not less than 0.10% by mass but not more than 0.15% by mass.

Zr produces dispersed particles (dispersion phase) as Mn and Cr. In the case of Zr, depending on the conditions of casting when Ti is contained, Zr is a cause of suppression of refinement of crystal grains of the ingot on the contrary. Zr, in particular, produces compounds of Ti—Zr to suppress refinement of crystal grains of $TiB_2$, and becomes a cause of coarsening of crystal grains. In addition, it may be a cause of lowered fatigue characteristics. Therefore, in the present invention, Zr, which is contained as an impurity due to the use of recycled base metal and for other reasons, is desirably added in such a range that crystal grains during casting are not coarsened. Specifically, the amount of Zr contained is to be not less than 0.05% by mass but not more than 0.2% by mass, and preferably not less than 0.05% by mass but not more than 0.10% by mass.

(Amount of Hydrogen: Not More than 0.25 ml/100 g Al)

Hydrogen ($H_2$) tends to be contained as an impurity. Especially, when the degree of processing of the forging is low, bubbles from hydrogen prevents contact-bonding of the forging during forging and other processes. This leads to generation of blisters which serve as starting points of destruction. Therefore, strength, anti-fracture toughness and fatigue characteristics are significantly lowered. In particular, in highly strengthened automotive suspension parts and the like, this influence of hydrogen is great. Therefore, the amount of hydrogen per 100 g of Al is to be not more than 0.25 ml, but it is needless to say that the less the amount contained, the better.

(Remainder)

The remainder is inevitable impurities and Al. Examples of inevitable impurities include C, Ni, Na, Ca, V and Hf. These tend to be contained as impurities, and are not preferably contained since they inhibit the characteristics of an automotive suspension part, but they are allowed when their total amount contained is not more than 0.10% by mass.

Although B is also an impurity, as well as Ti, it also functions to crystal grains of the ingot, and improve the processability during extrusion and forging. However, when it is contained in an amount higher than 300 ppm, coarse crystallized grains are also formed, which lowers the above-mentioned processability. Therefore, the amount of B contained is preferably not more than 300 ppm or lower.

(Average Grain Size: 50 μm or Lower)

The average grain size affects mechanical properties. When the average grain size is 50 μm, tensile properties and fatigue characteristics are lowered. The average grain size is to be preferably 45 μm or lower, and more preferably 40 μm or lower.

The average grain size can be calculated by the section method along the minor axis. That is, as shown in FIG. 1, the surface or section of the forging is etched with an appropriate etching solution and is photographed with an optical microscope at ×50 magnification. A straight line is drawn in the direction perpendicular to the major axis of the crystal grain size to determine the number of crystal grains on the straight line, and the length of the straight line is divided by the determined number of crystal grains.

(Crystallized Area Ratio: 3% or Lower)

The crystallized area ratio is determined by the amount of the elements added and their amount dissolved. When the crystallized area ratio is higher than 3%, the number of the propagation paths of cracks in an impact test increases, which lowers anti-fracture toughness and fatigue characteristics. The crystallized area ratio is to be preferably 2.5% or lower, and more preferably 2.0% or lower.

The crystallized area ratio can be calculated by photographing BEI with a SEM at ×400 magnification, and analyzing the image.

(Average Crystallized Grain Size: 8 μm or Lower)

The average crystallized grain size is determined by the amount added, solidification rate and other factors. When the average crystallized grain size is greater than 8 μm, the crystallized grains tends to serve as starting points of cracks in an impact test, leading to lowered anti-fracture toughness. Therefore, the average crystallized grain size is to be 8 μm or lower, and more preferably 6 μm or lower.

The average crystallized grain size can be determined by photographing BEI with a SEM at ×400 magnification, and converting the area of the crystallized grains to a circle having the same area by analytical software to calculate the average size.

The above-described aluminium alloy forging according to the present invention can have as high anti-fracture toughness and fatigue characteristics as an aluminium alloy forging having a Fe content of not more than 0.4% by mass. That is, the aluminium alloy forging according to the present invention can contain Fe, which is the most likely to be present as an impurity, in an amount higher than 0.4% by mass. Accordingly, use of recycled base metal which likely to have a high amount of Fe contained and use of virgin metal with low purity are facilitated.

The above-described aluminium alloy forging according to the present invention can be used as an automotive suspension part such as an upper arm and lower arm.

Figure 2A:
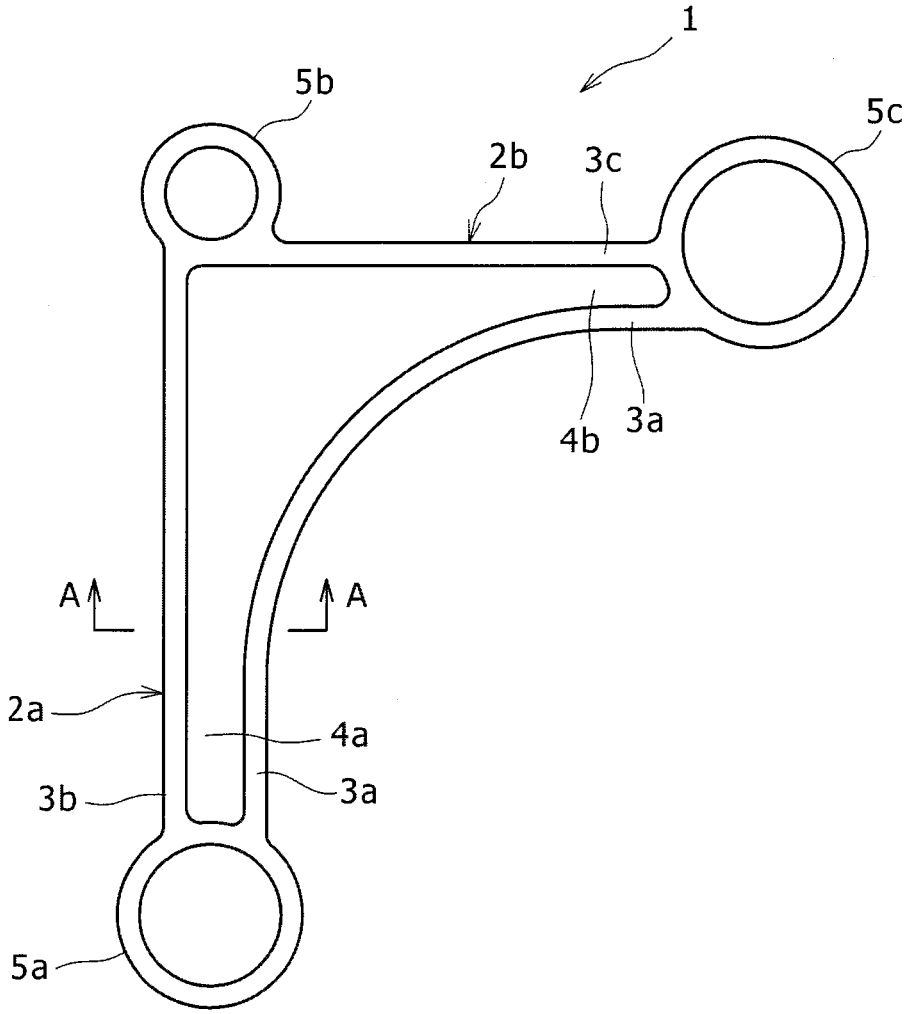
FIG. 2(*a*) is a plan view which illustrates an example of the aluminium alloy forging according to the present invention, while FIG. 2(*b*) is a is a cross-sectional view taken along line A-A in FIG. 2(*a*).
Figure 2B:
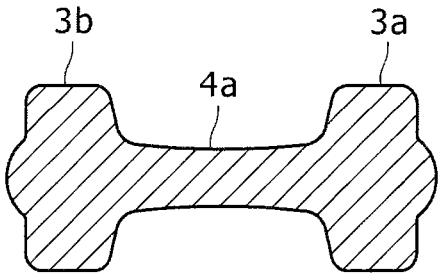

It should be noted that the automotive suspension part 1 (upper arm) shown in FIG. 2(*a*) is an example of a part forged into an approximately triangle shape by near net shape forming (near net shape forming).

Described more specifically, the automotive suspension part 1 has joint portions 5*a*, 5*b*, 5*c* such as ball joints at the apices of the triangle, respectively, and has such a configuration that these joint portions are connected with each other by arm portions 2*a*, 2*b*. The arm portions 2*a*, 2*b* have ribs extending along the longitudinal directions of the arm portions at the peripheral edges (both side edges) in their width directions. Described with reference to FIG. 2, the arm portion 2*a* has the ribs 3*a*, 3*b*, while the arm portion 2*b* has the ribs 3*a*, 3*c*. In addition, the arm portions 2*a*, 2*b* have webs extending along the longitudinal directions of the arm portions at the centers in their width directions. Described with reference to FIG. 2, the arm portion 2*a* has a web 4*a*, while the arm portion 2*b* has a web 4*b*.

The ribs 3*a*, 3*b*, 3*c* are common to the automotive suspension part, but are formed by relatively narrow and thick walls. In contrast, the webs 4*a*, 4*b* are common in the automotive suspension part, are formed by relatively wider and thinner walls than the ribs 3*a*, 3*b*, 3*c*. For this reason, described with reference to the arm portion 2*a*, for example, as shown in FIG. 2(*b*), the automotive suspension part has an approximately H-shaped cross section in which the two vertical wall portions correspond to the rib 3*a*, 3*b*, while the central horizontal wall portions correspond to the web 4*a*.

Now, the manufacturing method of the aluminium alloy forging according to the present invention will be described.

Figure 3:
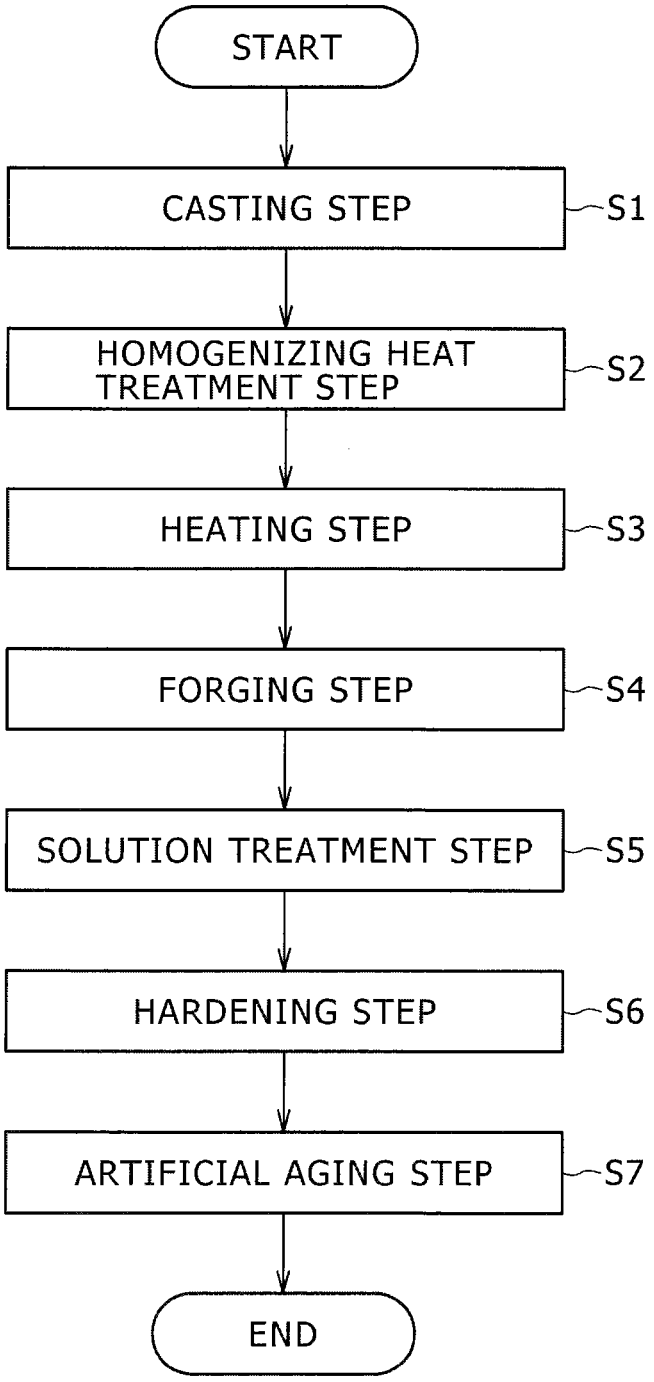
FIG. 3 is a flowchart which illustrates the flow of the manufacturing method of the aluminium alloy forging according to the present invention.

As shown in FIG. 3, the method for manufacturing an aluminium alloy forging according to the present invention comprises a casting step S1, a homogenizing heat treatment step S2, a heating step S3, a forging step S4, a solution treatment step S5, a hardening step S6, and an artificial aging step S7. By performing the steps in this order, the above-mentioned aluminium alloy forging can be manufactured.

It should be noted that, in the manufacturing method of the aluminium alloy forging according to the present invention, other steps may be further included unless they inhibit desired effects in the present invention. Examples of such steps include an extrusion step performed between the homogenizing heat treatment step and heating step, a forging roll step performed between the heating step and forging step, among others.

The casting step S1 is a step for casting an ingot of aluminium alloy having the above-mentioned composition. Explanation will be omitted as the composition has already been described in detail.

The amount of hydrogen can be controlled to not more than 0.25 ml (not more than 0.25 ml/100 g Al) per 100 g of aluminium alloy by bubbling, for example, argon gas, nitrogen gas, or chlorine gas, using a continuous degasser such as SNIF. More preferably, the amount of hydrogen is controlled to 0.15 ml/100 g Al or lower.

The casting step S1 is preferably performed at a heating temperature of 710 to 810° C. and at a casting rate of 230 to 330 mm/min.

When the heating temperature in the casting step S1 is lower than 710° C., dissolution time is required, preventing efficient operation. In addition, when the heating temperature in the casting step S1 is higher than 810° C., the amount of dross generated, which is an oxide, is high, and metal loss is increased, whereby an ingot cannot be obtained efficiently.

When the casting rate is lower than 230 mm/min., too long a casting time is required, thereby lowering efficiency. In addition, when the casting rate is higher than 330 mm/min., the risk of generation of cracks at the center of the ingot is increased.

It is preferable that the heating temperature is 710 to 750° C., and the casting rate is 200 to 300 mm/min.

Casting can be performed by a dissolution casting method such as the continuous casting method, semi-continuous casting method, hot top casting method, among which the continuous casting method is preferable.

In the present invention, the viscosity of molten metal is increased and the amount of shrinkage caused by solidification shrinkage is suppressed by adding a large amount of Fe. Accordingly, generation of shrinkage cracks in the continuous casting can be suppressed. Therefore, when the continuous casting method is employed as the casting step S1, the casting rate can be increased by about 5 to 30% than in the case of casting an ingot of known aluminium alloy having a Fe content of not more than 0.4% by mass.

The homogenizing heat treatment step S2 performed subsequently is a step for subjecting the ingot cast in the casting step S1 to a homogenizing heat treatment at 420 to 560° C. for 2.5 to 8 hours.

If the heating temperature in the homogenizing heat treatment step S2 is lower than 420° C., or the heating time is less than 2.5 hours, penetration of crystallized grains is insufficient, and the area ratio of the crystallized grains is increased. Therefore, achieving enhanced anti-fracture toughness of the product becomes difficult. In contrast, when the heating temperature in the homogenizing heat treatment step S2 is higher than 560° C., or when the heating time is longer than 8 hours, the crystallized grains can easily penetrate, but dispersed particles are coarsened. Therefore, these dispersed particles cannot be dispersed uniformly, finely and highly densely (hereinafter referred to as fine uniform dispersion). That is, the grain refining effect of crystal grains is impaired, whereby the average grain size is increased.

It should be noted that the heating temperature in the homogenizing heat treatment step S2 is preferably 500 to 540° C., and the heating time is preferably 4 to 8 hours.

The heating step S3 performed subsequently is a step for heating the ingot which has been subjected to the homogenizing heat treatment in the homogenizing heat treatment step S2 at 470 to 545° C. for 0.5 hours or more.

As mentioned above, Fe, as well as Mn and Cr, produces dispersed particles (dispersion phase) to prevent grain boundary migration after recrystallization as in the present invention. Accordingly, because a large amount of Fe is added, even if the heating step S3 is sufficiently performed, the number and density of dispersed particles can be as high as in a known material, and coarsening of crystal grains can be prevented. Therefore, crystal grains can maintain their fine state. Therefore, anti-fracture toughness and fatigue characteristics can be maintained as high as in a known material. This effect can be realized by sufficiently heating the ingot in this heating step S3 before performing the forging step S4, dissolving Fe-based crystallized grains to reduce the same, and further refining and rounded the crystallized grains as in the present invention.

When the heating temperature in the heating step S3 is lower than 470° C., or when the heating time is shorter than 0.5 hours, in the case of an aluminium alloy forging containing a large amount of Fe as in the present invention, solution of the Fe-based crystallized grains does not proceed, and thus anti-fracture toughness and fatigue characteristics cannot be maintained as high as in a known material. In contrast, when the heating temperature is higher than 545° C., the heat generated during processing creates the risk of generation of eutectic fusion, which is not desirable since generation of voids lowers mechanical characteristics. In addition, dispersed particles are coarsened and their density is lowered by the heat treatment at a high temperature, whereby the crystal grain refining effect cannot be obtained. The heating temperature in the heating step S3 is preferably 520 to 545°.

The forging step S4 performed subsequently is a step for forging the ingot heated in the heating step S3 at a forging end temperature of 330° C. or higher, and at a draft of 50 to 95% to obtain a forging having a predetermined shape.

When the forging end temperature in the forging step S4 is lower than 330° C., residual strain becomes too high. This increases the likelihood of recrystallization, and possibly coarsens crystal grains. In addition, when the draft in the forging step S4 is lower than 50%, defective casting may prevent contact bonding, and the sizes of crystal grains and crystallized grains cannot be sufficiently reduced. When the draft is higher than 95%, too high a processing rate may coarsen crystal grains due to recrystallization. It should be noted that the forging end temperature is preferably as high as possible as long as it does not exceed the heating temperature.

The forging end temperature is preferably 370° C. or higher, and the draft is preferably 70 to 90%.

Forging under such conditions can be performed by, for example, mechanical press and hydraulic press. The predetermined shape may be, for example, the approximately triangular shape shown in FIGS. 2(*a*) and 2(*b*), in the case of an automotive suspension part. Of course, this predetermined shape may be the shape of the final product.

The solution treatment step S5 performed subsequently is a step for subjecting the forging obtained in the forging step S4 to a solution treatment at 480 to 580° C. for longer than 0 hours but not longer than 24 hours. By performing this solution treatment, solution of the elements added to impart strength during the artificial aging step S7 described later can be proceeded, and anti-fracture toughness can be increased by refining the crystallized grains.

When the heating temperature in the solution treatment step S5 is lower than 480° C., or when the heating time is 0 hours (that is, the case where no heating treatment is performed), insufficient solutionizing prevents obtaining anti-fracture toughness, strength (tensile strength and 0.2% yield strength) and fatigue characteristics. In contrast, when the heating temperature in the solution treatment step S5 is higher than 580° C., or when the heating time is longer than 24 hours, crystal grains are coarsened, and therefore the average grain size tends to increase, which prevents obtaining anti-fracture toughness, strength (tensile strength and 0.2% yield strength), and fatigue characteristics.

It should be noted that the heating temperature in the solution treatment step S5 is preferably 540 to 560° C., and the heating time is preferably 2.5 to 8.0 hours.

The hardening step S6 performed subsequently is a step for hardening the forging subjected to the solution treatment in the solution treatment step S5 at 75° C. or lower. The strength can be improved by performing hardening.

When the hardening temperature in the hardening step S6 is higher than 75° C., the forging is not sufficiently hardened, and the strength cannot be sufficiently improved in the artificial aging step S7 described later.

It should be noted that the lower limit of the hardening temperature may be similar to the normal temperature of water for performing hardening, that is, about 15° C.

The artificial aging step S7 performed subsequently is a step for subjecting the forging which has been hardened in the hardening step S6 to an artificial aging treatment at 160 to 250° C. for 0.5 to 20 hours. It should be noted that the process from the forging step S4 through this artificial aging step S7 is a so-called T6 process. By performing such an artificial aging treatment, the strength necessary for, for example, an automotive suspension part, can be obtained.

When the heating temperature in the artificial aging step S7 is lower than 160° C., or when the heating time is shorter than 0.5 hours, sufficient strength, fatigue characteristics and corrosion resistance cannot be obtained. In contrast, when the heating temperature in the artificial aging step S7 is higher than 250° C., or when the heating time exceeds 20 hours, the aging treatment is overly performed so that sufficient strength and elongation cannot be obtained on the contrary. In addition, anti-fracture toughness and fatigue characteristics are also lowered.

It should be noted that the heating temperature in the artificial aging step S7 is preferably 170 to 250° C., and the heating time is preferably 3 to 12 hours.

According to the above-described manufacturing method of the aluminium alloy forging of the present invention, although the amount of Fe contained is higher than 0.4% by mass, an aluminium alloy forging which has anti-fracture toughness and fatigue characteristics as high as an aluminium alloy forging having a Fe content of not more than 0.4% by mass can be manufactured.

Examples

Now, the aluminium alloy forging according to the present invention and the method of manufacture for the same will be described more specifically with Examples which meet the requirements of the present invention and Comparative Examples which do not meet the requirements.

Ingots (cast bars with a diameter of 82 mm) of aluminium alloys having the compositions indicated by ingot numbers 1 to 53 in Tables 1 and 2 shown below were cast by semi-continuous casting. The conditions for semi-continuous casting were the heating temperature of 720° C., and the casting rate of 280 mm/min.

It should be noted that in Tables 1 and 2 shown below, the symbol "↓" indicates that the numerical value or description described in the cell thereabove is referred to.

TABLE 1

| Ingot number | Si (% by mass) | Fe (% by mass) | Cu (% by mass) | Mg (% by mass) | Ti (% by mass) | Zn (% by mass) | Mn (% by mass) | Cr (% by mass) | Zr (% by mass) | Amount of hydrogen (ml/100 g Al) | Remainder |
|---|---|---|---|---|---|---|---|---|---|---|---|
| 1 | 1.40 | 0.50 | 0.25 | 1.13 | 0.02 | 0.00 | 0.11 | 0.20 | 0.10 | 0.10 | Al and inevitable impurities |

TABLE 1-continued

| Ingot number | Si (% by mass) | Fe (% by mass) | Cu (% by mass) | Mg (% by mass) | Ti (% by mass) | Zn (% by mass) | Mn (% by mass) | Cr (% by mass) | Zr (% by mass) | Amount of hydrogen (ml/ 100 g Al) | Remainder |
|---|---|---|---|---|---|---|---|---|---|---|---|
| 2 | 0.45 | ↓ | ↓ | ↓ | ↓ | ↓ | ↓ | ↓ | ↓ | ↓ | ↓ |
| 3 | 0.70 | 0.90 | ↓ | ↓ | ↓ | ↓ | ↓ | ↓ | ↓ | ↓ | ↓ |
| 4 | ↓ | 0.45 | ↓ | ↓ | ↓ | ↓ | ↓ | ↓ | ↓ | ↓ | ↓ |
| 5 | ↓ | 0.50 | 0.35 | ↓ | ↓ | ↓ | ↓ | ↓ | ↓ | ↓ | ↓ |
| 6 | ↓ | ↓ | 0.10 | ↓ | ↓ | ↓ | ↓ | ↓ | ↓ | ↓ | ↓ |
| 7 | ↓ | ↓ | 0.25 | 1.1 | ↓ | ↓ | ↓ | ↓ | ↓ | ↓ | ↓ |
| 8 | ↓ | ↓ | ↓ | 0.85 | ↓ | ↓ | ↓ | ↓ | ↓ | ↓ | ↓ |
| 9 | ↓ | ↓ | ↓ | 1.13 | 0.08 | ↓ | ↓ | ↓ | ↓ | ↓ | ↓ |
| 10 | ↓ | ↓ | ↓ | ↓ | 0.02 | ↓ | ↓ | ↓ | ↓ | ↓ | ↓ |
| 11 | ↓ | ↓ | ↓ | ↓ | 0.02 | 0.03 | ↓ | ↓ | ↓ | ↓ | ↓ |
| 12 | ↓ | ↓ | ↓ | ↓ | ↓ | 0.02 | 0.85 | ↓ | ↓ | ↓ | ↓ |
| 13 | ↓ | ↓ | ↓ | ↓ | ↓ | ↓ | 0.03 | ↓ | ↓ | ↓ | ↓ |
| 14 | ↓ | ↓ | ↓ | ↓ | ↓ | ↓ | 0.11 | 0.35 | ↓ | ↓ | ↓ |
| 15 | ↓ | ↓ | ↓ | ↓ | ↓ | ↓ | ↓ | 0.15 | ↓ | ↓ | ↓ |
| 16 | ↓ | ↓ | ↓ | ↓ | ↓ | ↓ | ↓ | 0.20 | 0.15 | ↓ | ↓ |
| 17 | ↓ | ↓ | ↓ | ↓ | ↓ | ↓ | ↓ | ↓ | 0.08 | ↓ | ↓ |
| 18 | ↓ | ↓ | ↓ | ↓ | ↓ | ↓ | None | ↓ | 0.10 | ↓ | ↓ |
| 19 | ↓ | ↓ | ↓ | ↓ | ↓ | ↓ | 0.11 | None | ↓ | ↓ | ↓ |
| 20 | ↓ | ↓ | ↓ | ↓ | ↓ | ↓ | ↓ | 0.20 | None | ↓ | ↓ |
| 21 | ↓ | ↓ | ↓ | ↓ | ↓ | ↓ | None | None | 0.10 | ↓ | ↓ |
| 22 | ↓ | ↓ | ↓ | ↓ | ↓ | ↓ | None | 0.20 | None | ↓ | ↓ |
| 23 | ↓ | ↓ | ↓ | ↓ | ↓ | ↓ | 0.11 | None | None | ↓ | ↓ |
| 24 | 0.80 | ↓ | ↓ | ↓ | ↓ | ↓ | ↓ | 0.20 | 0.10 | ↓ | ↓ |
| 25 | 0.60 | ↓ | ↓ | ↓ | ↓ | ↓ | ↓ | ↓ | ↓ | ↓ | ↓ |
| 26 | 0.70 | 0.60 | ↓ | ↓ | ↓ | ↓ | ↓ | ↓ | ↓ | ↓ | ↓ |
| 27 | ↓ | 0.60 | ↓ | ↓ | ↓ | ↓ | ↓ | ↓ | ↓ | ↓ | ↓ |
| 28 | ↓ | 0.50 | 0.30 | ↓ | ↓ | ↓ | ↓ | ↓ | ↓ | ↓ | ↓ |
| 29 | ↓ | ↓ | 0.20 | 1.13 | ↓ | ↓ | ↓ | ↓ | ↓ | ↓ | ↓ |
| 30 | ↓ | ↓ | 0.25 | 1.2 | ↓ | ↓ | ↓ | ↓ | ↓ | ↓ | ↓ |
| 31 | ↓ | ↓ | ↓ | 0.85 | ↓ | ↓ | ↓ | ↓ | ↓ | ↓ | ↓ |
| 32 | ↓ | ↓ | ↓ | ↓ | 0.05 | ↓ | ↓ | ↓ | ↓ | ↓ | ↓ |
| 33 | ↓ | ↓ | ↓ | ↓ | 0.02 | ↓ | ↓ | ↓ | ↓ | ↓ | ↓ |
| 34 | ↓ | ↓ | ↓ | ↓ | ↓ | 0.00 | 0.30 | ↓ | ↓ | ↓ | ↓ |
| 35 | ↓ | ↓ | ↓ | ↓ | ↓ | ↓ | 0.10 | ↓ | ↓ | ↓ | ↓ |
| 36 | ↓ | ↓ | ↓ | ↓ | ↓ | ↓ | 0.11 | 0.30 | ↓ | ↓ | ↓ |
| 37 | ↓ | ↓ | ↓ | ↓ | ↓ | ↓ | ↓ | 0.20 | ↓ | ↓ | ↓ |
| 38 | ↓ | ↓ | ↓ | ↓ | ↓ | ↓ | ↓ | ↓ | 0.10 | ↓ | ↓ |
| 39 | ↓ | ↓ | ↓ | ↓ | ↓ | ↓ | ↓ | ↓ | 0.08 | ↓ | ↓ |

TABLE 2

| Ingot number | Si (% by mass) | Fe (% by mass) | Cu (% by mass) | Mg (% by mass) | Ti (% by mass) | Zn (% by mass) | Mn (% by mass) | Cr (% by mass) | Zr (% by mass) | Amount of hydrogen (ml/ 100 g Al) | Remainder |
|---|---|---|---|---|---|---|---|---|---|---|---|
| 40 | 1.80 | 0.50 | 0.25 | 1.13 | 0.02 | 0.00 | 0.11 | 0.20 | 0.10 | 0.10 | Al and inevitable impurities |
| 41 | 0.35 | ↓ | ↓ | ↓ | ↓ | ↓ | ↓ | ↓ | ↓ | ↓ | ↓ |
| 42 | 0.70 | 1.2 | ↓ | ↓ | ↓ | ↓ | ↓ | ↓ | ↓ | ↓ | ↓ |
| 43 | ↓ | 0.20 | ↓ | ↓ | ↓ | ↓ | ↓ | ↓ | ↓ | ↓ | ↓ |
| 44 | ↓ | 0.50 | 0.60 | ↓ | ↓ | ↓ | ↓ | ↓ | ↓ | ↓ | ↓ |
| 45 | ↓ | ↓ | 0.25 | 1.5 | ↓ | ↓ | ↓ | ↓ | ↓ | ↓ | ↓ |
| 46 | ↓ | ↓ | ↓ | 0.5 | ↓ | ↓ | ↓ | ↓ | ↓ | ↓ | ↓ |
| 47 | ↓ | ↓ | ↓ | 1.13 | 0.3 | ↓ | ↓ | ↓ | ↓ | ↓ | ↓ |
| 48 | ↓ | ↓ | ↓ | ↓ | 0.00 | ↓ | ↓ | ↓ | ↓ | ↓ | ↓ |
| 49 | ↓ | ↓ | ↓ | ↓ | 0.02 | 0.5 | ↓ | ↓ | ↓ | ↓ | ↓ |
| 50 | ↓ | ↓ | ↓ | ↓ | ↓ | 0.00 | 1.50 | ↓ | ↓ | ↓ | ↓ |
| 51 | ↓ | ↓ | ↓ | ↓ | ↓ | ↓ | 0.11 | 0.6 | ↓ | ↓ | ↓ |
| 52 | ↓ | ↓ | ↓ | ↓ | ↓ | ↓ | ↓ | 0.20 | 0.5 | ↓ | ↓ |
| 53 | ↓ | ↓ | ↓ | ↓ | ↓ | ↓ | ↓ | ↓ | 0.10 | 0.35 | ↓ |

The ingots according to ingot numbers 1 to 53 cast by semi-continuous casting were faced at their outer surfaces for a thickness of 3 mm, and were cut into the lengths of 500 mm. The ingots were then subjected to, under the respective conditions shown in Table 3 below, a homogenizing heat treatment, a heat treatment, a hot mold forging using a mechanical press, a solution treatment, hardening, and an artificial aging treatment, producing forgings 1 to 53.

TABLE 3

| Homogenizing heat treatment | | Heating | | Forging | | Solution treatment | | Hardening | Artificial aging treatment | |
|---|---|---|---|---|---|---|---|---|---|---|
| Heating temperature (° C.) | Heating time (hours) | Heating temperature (° C.) | Heating time (hours) | Forging end temperature (° C.) | Draft (%) | Heating temperature (° C.) | Heating time (hours) | Hardening temperature (° C.) | Heating temperature (° C.) | Heating time (hours) |
| 520 | 4.0 | 540 | 1.5 | 420 | 70 | 560 | 4 | 40 | 175 | 8 |

Forgings 1 to 53 were evaluated for their average grain sizes (μm), crystallized area ratios (%), average crystallized grain sizes (μm), mechanical characteristics, Charpy impact value (J/cm$^2$) as anti-fracture toughness, rotation bending fatigue strengths (MPa) at the $10^7$ cycle as fatigue characteristics, and stress corrosion cracking resistance as corrosion resistance. It should be noted that tensile strength (MPa), 0.2% yield strength (MPa) and elongation (%) were measured as mechanical characteristics.

These evaluations were performed as follows.

The average grain size (μm) was calculated by etching the sections of the forgings, photographing the sections with an optical microscope at 50× magnification, drawing a straight line in the direction perpendicular to the major axis of the crystal grain size to determine the number of crystal grains on the straight line, and dividing the distance by the number of the crystal grains measured (refer to FIG. 1).

The average grain size was determined acceptable when it was 50 μm or lower, while it was determined unacceptable when it was greater than 50 μm.

The crystallized area ratio (%) was calculated by photographing BEI with a SEM at 400× magnification, and analyzing the image.

The crystallized area ratio was determined acceptable (O) when it was 3% or lower, while it was determined unacceptable (x) when it was higher than 3%.

The average crystallized grain size (μm) was calculated by photographing BEI with a SEM at 400× magnification, and converting the area of the crystallized grains to a circle having the same area by analytical software to calculate the average size.

The average crystallized grain size was determined acceptable (O) which it was 8 μm or lower, while it is determined unacceptable (x) when it was greater than 8 μm.

The mechanical characteristics were determined by cutting out two tensile test pieces (L direction, #4 test piece) according to JIS Z 2201 from each of the forgings at optional portions along the longitudinal direction thereof, performing measurement on the test pieces by a tensile tester according to JIS Z 2241, and calculating the average value of the two test pieces.

As for the mechanical characteristics, a tensile strength of 320 MPa or higher was determined acceptable, while that lower than 320 MPa was determined unacceptable; a 0.2% yield strength of 290 MPa or higher was determined acceptable, while that lower than 290 MPa was determined unacceptable; and elongation of 10% or higher was determined acceptable, while that lower than 10% was determined unacceptable.

The Charpy impact value (J/cm$^2$) was determined by cutting out two Charpy test pieces (LT direction) according to JIS Z 2202 from each of the forgings at optional portions along the longitudinal direction, forming a U-notch with a depth of 2 mm and a tip R of 1 mm at the center of a 10-mm square bar with a length of 55 mm, measuring this by a Charpy tester according to IS B 7722, and calculating the average value of the two test pieces.

A Charpy impact value of 20 J/cm$^2$ or higher was determined acceptable, while that lower than 20 J/cm$^2$ was determined unacceptable.

The rotating bending fatigue strength was measured according to JIS Z 2274. The rotating bending fatigue strength was evaluated by the strength at the $10^7$ cycle, and a value of 115 MPa or higher was determined acceptable (O), while a value lower than 115 MPa was determined unacceptable (x).

The stress corrosion cracking resistance was evaluated by preparing C-ring-shaped test pieces, according to the alternate immersion technique defined in ASTM G47. In addition, assuming that the alloy was used as an automotive suspension part, and to simulate the state that a tensile stress was applied, a stress equivalent to 75% of a yield strength applied in the L direction of the test pieces for the mechanical characteristics was applied in the ST direction of the C-ring-shaped test pieces.

In this state, the test pieces were repeatedly immersed into brine and lifted up therefrom for 30 days, to observe if stress corrosion cracks were generated in the test piece.

As for the stress corrosion cracking resistance, test pieces which had no stress corrosion crack generated were determined acceptable (O), while those which had stress corrosion cracks generated were determined unacceptable (x).

The evaluation results of the average grain size (μm), crystallized area ratio (%), average crystallized grain size (μm), mechanical characteristics, Charpy impact value (J/cm$^2$), rotating bending fatigue strength (MPa) and stress corrosion cracking resistance of forgings 1 to 53 are shown in Tables 4 and 5 below.

TABLE 4

| | | | | Mechanical characteristics | | | | Rotating | |
|---|---|---|---|---|---|---|---|---|---|
| Forging number | Average grain size (μm) | Crystallized area ratio (%) | Average crystallized grain size (μm) | Tensile strength (MPa) | 0.2% Yield strength (MPa) | Elongation (%) | Charpy impact value (J/cm$^2$) | bending fatigue strength (MPa) | Stress corrosion cracking resistance |
| 1 | 35 | ○ | ○ | 355 | 311 | 11.1 | 21.6 | ○ | ○ |
| 2 | 48 | ○ | ○ | 325 | 292 | 18.4 | 36.8 | ○ | ○ |

TABLE 4-continued

| Forging number | Average grain size (μm) | Crystallized area ratio (%) | Average crystallized grain size (μm) | Mechanical characteristics: Tensile strength (MPa) | 0.2% Yield strength (MPa) | Elongation (%) | Charpy impact value (J/cm$^2$) | Rotating bending fatigue strength (MPa) | Stress corrosion cracking resistance |
|---|---|---|---|---|---|---|---|---|---|
| 3 | 36 | ○ | ○ | 340 | 312 | 10.7 | 20.7 | ○ | ○ |
| 4 | 43 | ○ | ○ | 335 | 298 | 15.8 | 30.1 | ○ | ○ |
| 5 | 41 | ○ | ○ | 356 | 321 | 14.8 | 28.1 | ○ | ○ |
| 6 | 42 | ○ | ○ | 333 | 301 | 15.6 | 30.1 | ○ | ○ |
| 7 | 39 | ○ | ○ | 352 | 315 | 13.8 | 22.4 | ○ | ○ |
| 8 | 41 | ○ | ○ | 333 | 300 | 16.0 | 33.6 | ○ | ○ |
| 9 | 35 | ○ | ○ | 348 | 313 | 15.5 | 28.1 | ○ | ○ |
| 10 | 42 | ○ | ○ | 342 | 308 | 15.3 | 30.1 | ○ | ○ |
| 11 | 41 | ○ | ○ | 346 | 311 | 15.5 | 29.7 | ○ | ○ |
| 12 | 35 | ○ | ○ | 349 | 317 | 12.1 | 23.2 | ○ | ○ |
| 13 | 44 | ○ | ○ | 336 | 301 | 15.4 | 33.8 | ○ | ○ |
| 14 | 39 | ○ | ○ | 347 | 315 | 14.7 | 26.9 | ○ | ○ |
| 15 | 44 | ○ | ○ | 339 | 304 | 15.6 | 30.4 | ○ | ○ |
| 16 | 37 | ○ | ○ | 348 | 318 | 15.4 | 28.7 | ○ | ○ |
| 17 | 44 | ○ | ○ | 345 | 312 | 15.7 | 29.9 | ○ | ○ |
| 18 | 41 | ○ | ○ | 341 | 306 | 15.5 | 31.4 | ○ | ○ |
| 19 | 42 | ○ | ○ | 340 | 305 | 15.6 | 30.4 | ○ | ○ |
| 20 | 42 | ○ | ○ | 344 | 311 | 15.8 | 30.1 | ○ | ○ |
| 21 | 41 | ○ | ○ | 340 | 306 | 16.2 | 31.8 | ○ | ○ |
| 22 | 42 | ○ | ○ | 338 | 305 | 16.0 | 31.5 | ○ | ○ |
| 23 | 47 | ○ | ○ | 336 | 301 | 15.4 | 30.7 | ○ | ○ |
| 24 | 36 | ○ | ○ | 352 | 315 | 12.5 | 21.0 | ○ | ○ |
| 25 | 41 | ○ | ○ | 330 | 300 | 18.1 | 32.6 | ○ | ○ |
| 26 | 37 | ○ | ○ | 339 | 304 | 12.0 | 24.3 | ○ | ○ |
| 27 | 43 | ○ | ○ | 335 | 298 | 15.8 | 30.1 | ○ | ○ |
| 28 | 41 | ○ | ○ | 356 | 321 | 14.8 | 28.1 | ○ | ○ |
| 29 | 41 | ○ | ○ | 334 | 299 | 15.4 | 29.9 | ○ | ○ |
| 30 | 40 | ○ | ○ | 348 | 313 | 14.5 | 24.5 | ○ | ○ |
| 31 | 40 | ○ | ○ | 339 | 302 | 15.9 | 33.1 | ○ | ○ |
| 32 | 36 | ○ | ○ | 347 | 315 | 15.6 | 28.7 | ○ | ○ |
| 33 | 42 | ○ | ○ | 342 | 308 | 15.3 | 30.1 | ○ | ○ |
| 34 | 40 | ○ | ○ | 344 | 311 | 15.5 | 27.1 | ○ | ○ |
| 35 | 43 | ○ | ○ | 340 | 306 | 12.3 | 29.4 | ○ | ○ |
| 36 | 38 | ○ | ○ | 344 | 300 | 14.9 | 27.4 | ○ | ○ |
| 37 | 44 | ○ | ○ | 339 | 304 | 15.6 | 30.4 | ○ | ○ |
| 38 | 37 | ○ | ○ | 347 | 312 | 15.4 | 30.1 | ○ | ○ |
| 39 | 44 | ○ | ○ | 345 | 312 | 15.7 | 29.9 | ○ | ○ |

TABLE 5

| Forging number | Average grain size (μm) | Crystallized area ratio (%) | Average crystallized grain size (μm) | Mechanical characteristics: Tensile strength (MPa) | 0.2% Yield strength (MPa) | Elongation (%) | Charpy impact value (J/cm$^2$) | Rotating bending fatigue strength (MPa) | Stress corrosion cracking resistance |
|---|---|---|---|---|---|---|---|---|---|
| 40 | 35 | X | X | 360 | 331 | 9.7 | 14.7 | X | X |
| 41 | 507 | ○ | ○ | 272 | 246 | 14.2 | 23.3 | X | ○ |
| 42 | 34 | X | X | 342 | 326 | 8.2 | 7.8 | X | X |
| 43 | 809 | ○ | ○ | 270 | 245 | 18.4 | 33.8 | X | ○ |
| 44 | 41 | ○ | ○ | 365 | 333 | 11.1 | 27.6 | ○ | X |
| 45 | 37 | X | X | 359 | 325 | 9.8 | 9.8 | X | X |
| 46 | 246 | ○ | ○ | 294 | 267 | 15.9 | 34.0 | X | X |
| 47 | 42 | ○ | X | 346 | 312 | 10.2 | 8.3 | X | ○ |
| 48 | 250 | ○ | ○ | 287 | 264 | 15.4 | 30.4 | X | ○ |
| 49 | 41 | ○ | ○ | 355 | 324 | 8.7 | 14.8 | X | X |
| 50 | 36 | X | X | 351 | 319 | 9.1 | 8.3 | X | ○ |
| 51 | 35 | X | X | 348 | 314 | 11.3 | 18.6 | X | ○ |
| 52 | 68 | ○ | ○ | 325 | 295 | 11.4 | 20.3 | X | ○ |
| 53 | 35 | ○ | ○ | 315 | 281 | 7.6 | 14.9 | X | ○ |

As shown in Tables 4 and 5, forgings 1 to 39 met all the requirements of the present invention, and therefore provided good evaluation results.

In contrast, forgings 40 to 53 did not meet all the requirements of the present invention, and therefore did not provide good evaluation results.

Specifically, since forging 40 had an Si content which was higher than the upper limit, coarse particles of simple substance of Si were crystallized out and deposited therein, and its crystallized area ratio and average crystallized grain size were determined unacceptable. In addition, its elongation, Charpy impact value, rotating bending fatigue strength, and stress corrosion cracking resistance were determined unacceptable.

In forging 41, the amount of Si contained was lower than the lower limit thereof, so that crystal grains were coarsened, and its average grain size was determined unacceptable. In addition, its tensile strength, 0.2% yield strength, and rotating bending fatigue strength were determined unacceptable.

In forging 42, the amount of Fe contained was higher than the upper limit thereof, so that crystallized grains such as Al—Fe—Si-based intermetallic compounds were coarsened, its crystallized area ratio and average crystallized grain size were determined unacceptable. In addition, its elongation, Charpy impact value, rotating bending fatigue strength, and stress corrosion cracking resistance were determined unacceptable.

In forging 43, the amount of Fe contained was lower than the lower limit thereof, so that the effects in preventing coarsening of crystal grains could not be obtained, and crystal grains could not maintain their fine state. Accordingly, its average grain size was determined unacceptable, and its tensile strength, 0.2% yield strength, and rotating bending fatigue strength were determined unacceptable.

In forging 44, the amount of Cu contained was higher than the upper limit thereof, so that the sensitivity of the Al alloy forging to the stress corrosion crack and grain boundary corrosion was significantly increased. Accordingly, its stress corrosion cracking resistance was determined unacceptable.

In forging 45, the amount of Mg contained was higher than the upper limit thereof, so that crystallized grains were more likely to be formed. As a result, its crystallized area ratio and average crystallized grain size were determined unacceptable. In addition, its elongation, Charpy impact value, rotating bending fatigue strength, and stress corrosion cracking resistance were determined unacceptable.

In forging 46, the amount of Mg contained was lower than the lower limit thereof, so that recrystallization was more likely to be caused, and coarsening of crystal grains occurred. As a result, its average grain size was determined unacceptable. In addition, its tensile strength, 0.2% yield strength, rotating bending fatigue strength, and stress corrosion cracking resistance were determined unacceptable.

In forging 47, the amount of Ti contained was higher than the upper limit thereof, so that coarse crystallized grains were formed. As a result, its average crystallized grain size was determined unacceptable. In addition, its Charpy impact value and rotating bending fatigue strength were determined unacceptable.

In forging 48, the amount of Ti contained was lower than the lower limit thereof, so that crystal grains were coarsened. As a result, its average grain size was determined unacceptable. In addition, its tensile strength, 0.2% yield strength, and rotating bending fatigue strength were determined unacceptable.

In forging 49, the amount of Zn contained was higher than the upper limit thereof, so that its elongation, Charpy impact value, rotating bending fatigue strength, and stress corrosion cracking resistance were determined unacceptable.

In forging 50, the amount of Mn contained was higher than the upper limit thereof, so that coarse crystallized grains were produced therein. As a result, its crystallized area ratio and average crystallized grain size were determined unacceptable. In addition, its elongation, Charpy impact value, and rotating bending fatigue strength were determined unacceptable.

In forging 51, the amount of Cr contained was higher than the upper limit thereof, so that coarse crystallized grains were produced therein. As a result, its crystallized area ratio and average crystallized grain size were determined unacceptable. In addition, its elongation, and Charpy impact value, rotating bending fatigue strength were determined unacceptable.

In forging 52, the amount of Zr contained was higher than the upper limit thereof, so that its crystal grains were coarsened. As a result, its average grain size was determined unacceptable. In addition, its rotating bending fatigue strength was determined unacceptable.

It should be noted that in forging 53, even when its chemical constituents and composition met the requirements of the present invention, bubbles were generated in the ingot since the amount of hydrogen was higher than 0.25 ml/100 g Al, and its strength, elongation, Charpy impact value, and rotating bending fatigue strength were lowered.

Next, manufacturing conditions were examined by employing the composition of ingot number 5 which provided good evaluation results. In this case, the amount of hydrogen was 0.10 ml/100 g Al.

The manufacturing conditions are shown in Tables 6 and 7 below.

It should be noted that in Tables 6 and 7 below, the symbol "↓" indicates that the numerical value described thereabove is referred to.

TABLE 6

| | Casting step | | Homogenizing heat treatment step | | Heating step | | Forging step | | Solution treatment step | | Hardening | Artificial aging step | |
|---|---|---|---|---|---|---|---|---|---|---|---|---|---|
| Manufacturing number | Heating temperature (° C.) | Casting rate (mm/min.) | Heating temperature (° C.) | Heating time (h) | Heating temperature (° C.) | Heating time (h) | Forging end temperature (° C.) | Draft (%) | Heating temperature (° C.) | Heating time (h) | step Hardening temperature (° C.) | Heating temperature (° C.) | Heating time (h) |
| 1 | 720 | 310 | 520 | 4.0 | 540 | 1.5 | 480 | 70 | 560 | 4 | 40 | 175 | 8 |
| 2 | ↓ | 280 | 540 | ↓ | ↓ | ↓ | ↓ | ↓ | ↓ | ↓ | ↓ | ↓ | ↓ |
| 3 | ↓ | ↓ | 450 | ↓ | ↓ | ↓ | ↓ | ↓ | ↓ | ↓ | ↓ | ↓ | ↓ |
| 4 | ↓ | ↓ | 520 | 6.0 | ↓ | ↓ | ↓ | ↓ | ↓ | ↓ | ↓ | ↓ | ↓ |
| 5 | ↓ | ↓ | ↓ | 3.0 | ↓ | ↓ | ↓ | ↓ | ↓ | ↓ | ↓ | ↓ | ↓ |
| 6 | ↓ | ↓ | ↓ | 4.0 | 530 | ↓ | ↓ | ↓ | ↓ | ↓ | ↓ | ↓ | ↓ |
| 7 | ↓ | ↓ | ↓ | ↓ | 490 | ↓ | ↓ | ↓ | ↓ | ↓ | ↓ | ↓ | ↓ |
| 8 | ↓ | ↓ | ↓ | ↓ | ↓ | 1.0 | ↓ | ↓ | ↓ | ↓ | ↓ | ↓ | ↓ |
| 9 | ↓ | ↓ | ↓ | ↓ | ↓ | ↓ | 350 | ↓ | ↓ | ↓ | ↓ | ↓ | ↓ |
| 10 | ↓ | ↓ | ↓ | ↓ | ↓ | ↓ | 480 | 90 | ↓ | ↓ | ↓ | ↓ | ↓ |
| 11 | ↓ | ↓ | ↓ | ↓ | ↓ | ↓ | ↓ | 60 | ↓ | ↓ | ↓ | ↓ | ↓ |
| 12 | ↓ | ↓ | ↓ | ↓ | ↓ | ↓ | ↓ | 70 | 560 | ↓ | ↓ | ↓ | ↓ |
| 13 | ↓ | ↓ | ↓ | ↓ | ↓ | ↓ | ↓ | ↓ | 500 | ↓ | ↓ | ↓ | ↓ |

TABLE 6-continued

| Manufacturing number | Casting step: Heating temperature (° C.) | Casting step: Casting rate (mm/min.) | Homogenizing heat treatment step: Heating temperature (° C.) | Homogenizing heat treatment step: Heating time (h) | Heating step: Heating temperature (° C.) | Heating step: Heating time (h) | Forging step: Forging end temperature (° C.) | Forging step: Draft (%) | Solution treatment step: Heating temperature (° C.) | Solution treatment step: Heating time (h) | Hardening step: Hardening temperature (° C.) | Artificial aging step: Heating temperature (° C.) | Artificial aging step: Heating time (h) |
|---|---|---|---|---|---|---|---|---|---|---|---|---|---|
| 14 | ↓ | ↓ | ↓ | ↓ | ↓ | ↓ | ↓ | ↓ | 560 | 20 | ↓ | ↓ | ↓ |
| 15 | ↓ | ↓ | ↓ | ↓ | ↓ | ↓ | ↓ | ↓ | ↓ | 4 | 65 | ↓ | ↓ |
| 16 | ↓ | ↓ | ↓ | ↓ | ↓ | ↓ | ↓ | ↓ | ↓ | ↓ | 40 | 230 | ↓ |
| 17 | ↓ | ↓ | ↓ | ↓ | ↓ | ↓ | ↓ | ↓ | ↓ | ↓ | ↓ | 180 | ↓ |
| 18 | ↓ | ↓ | ↓ | ↓ | ↓ | ↓ | ↓ | ↓ | ↓ | ↓ | ↓ | 175 | 18 |
| 19 | ↓ | ↓ | ↓ | ↓ | ↓ | ↓ | ↓ | ↓ | ↓ | ↓ | ↓ | ↓ | 1.0 |

TABLE 7

| Manufacturing number | Casting step: Heating temperature (° C.) | Casting step: Casting rate (mm/min.) | Homogenizing heat treatment step: Heating temperature (° C.) | Homogenizing heat treatment step: Heating time (h) | Heating step: Heating temperature (° C.) | Heating step: Heating time (h) | Forging step: Forging end temperature (° C.) | Forging step: Draft (%) | Solution treatment step: Heating temperature (° C.) | Solution treatment step: Heating time (h) | Hardening step: Hardening temperature (° C.) | Artificial aging step: Heating temperature (° C.) | Artificial aging step: Heating time (h) |
|---|---|---|---|---|---|---|---|---|---|---|---|---|---|
| 20 | 720 | 400 | 520 | 4.0 | 540 | 1.5 | 420 | 70 | 560 | 4 | 40 | 175 | 8 |
| 21 | ↓ | 280 | 580 | ↓ | ↓ | ↓ | ↓ | ↓ | ↓ | ↓ | ↓ | ↓ | ↓ |
| 22 | ↓ | ↓ | 400 | ↓ | ↓ | ↓ | ↓ | ↓ | ↓ | ↓ | ↓ | ↓ | ↓ |
| 23 | ↓ | ↓ | 520 | 20 | ↓ | ↓ | ↓ | ↓ | ↓ | ↓ | ↓ | ↓ | ↓ |
| 24 | ↓ | ↓ | ↓ | 1.0 | ↓ | ↓ | ↓ | ↓ | ↓ | ↓ | ↓ | ↓ | ↓ |
| 25 | ↓ | ↓ | ↓ | 4 | 580 | ↓ | ↓ | ↓ | ↓ | ↓ | ↓ | ↓ | ↓ |
| 26 | ↓ | ↓ | ↓ | ↓ | 450 | ↓ | ↓ | ↓ | ↓ | ↓ | ↓ | ↓ | ↓ |
| 27 | ↓ | ↓ | ↓ | ↓ | 540 | 0.25 | ↓ | ↓ | ↓ | ↓ | ↓ | ↓ | ↓ |
| 28 | ↓ | ↓ | ↓ | ↓ | ↓ | ↓ | 300 | ↓ | ↓ | ↓ | ↓ | ↓ | ↓ |
| 29 | ↓ | ↓ | ↓ | ↓ | ↓ | ↓ | 420 | 98 | ↓ | ↓ | ↓ | ↓ | ↓ |
| 30 | ↓ | ↓ | ↓ | ↓ | ↓ | ↓ | ↓ | 30 | ↓ | ↓ | ↓ | ↓ | ↓ |
| 31 | ↓ | ↓ | ↓ | ↓ | ↓ | ↓ | ↓ | 70 | 600 | ↓ | ↓ | ↓ | ↓ |
| 32 | ↓ | ↓ | ↓ | ↓ | ↓ | ↓ | ↓ | ↓ | 450 | ↓ | ↓ | ↓ | ↓ |
| 33 | ↓ | ↓ | ↓ | ↓ | ↓ | ↓ | ↓ | ↓ | 560 | 30 | ↓ | ↓ | ↓ |
| 34 | ↓ | ↓ | ↓ | ↓ | ↓ | ↓ | ↓ | ↓ | ↓ | 4 | 90 | ↓ | ↓ |
| 35 | ↓ | ↓ | ↓ | ↓ | ↓ | ↓ | ↓ | ↓ | ↓ | ↓ | 40 | 300 | ↓ |
| 36 | ↓ | ↓ | ↓ | ↓ | ↓ | ↓ | ↓ | ↓ | ↓ | ↓ | ↓ | 150 | ↓ |
| 37 | ↓ | ↓ | ↓ | ↓ | ↓ | ↓ | ↓ | ↓ | ↓ | ↓ | ↓ | 175 | 30 |
| 38 | ↓ | ↓ | ↓ | ↓ | ↓ | ↓ | ↓ | ↓ | ↓ | ↓ | ↓ | ↓ | 0.25 |

The average grain size (μm), crystallized area ratio (%), average crystallized grain size (μm), mechanical characteristics, Charpy impact value (J/cm$^2$), rotating bending fatigue strength (MPa) and stress corrosion cracking resistance of manufacturing numbers 1 to 38 were evaluated in a manner similar to those mentioned above.

The evaluation results are shown in Tables 8 and 9 below.

TABLE 8

| Forging number | Average grain size (μm) | Crystallized area ratio (%) | Average crystallized grain size (μm) | Mechanical characteristics: Tensile strength (MPa) | Mechanical characteristics: 0.2% Yield strength (MPa) | Mechanical characteristics: Elongation (%) | Charpy impact value (J/cm$^2$) | Rotating bending fatigue strength (MPa) | Stress corrosion cracking resistance |
|---|---|---|---|---|---|---|---|---|---|
| 1 | 33 | ○ | ○ | 378 | 346 | 15.9 | 36.2 | ○ | ○ |
| 2 | 45 | ○ | ○ | 358 | 325 | 14.7 | 34.9 | ○ | ○ |
| 3 | 40 | ○ | ○ | 355 | 320 | 14.1 | 24.8 | ○ | ○ |
| 4 | 45 | ○ | ○ | 364 | 330 | 15.2 | 30.7 | ○ | ○ |
| 5 | 39 | ○ | ○ | 335 | 304 | 12.6 | 25.3 | ○ | ○ |
| 6 | 46 | ○ | ○ | 358 | 324 | 15.5 | 39.8 | ○ | ○ |
| 7 | 40 | ○ | ○ | 347 | 312 | 13.4 | 23.4 | ○ | ○ |
| 8 | 42 | ○ | ○ | 340 | 303 | 12.8 | 22.9 | ○ | ○ |
| 9 | 48 | ○ | ○ | 350 | 320 | 14.0 | 25.1 | ○ | ○ |
| 10 | 32 | ○ | ○ | 377 | 344 | 15.8 | 30.4 | ○ | ○ |
| 11 | 46 | ○ | ○ | 331 | 298 | 13.1 | 24.7 | ○ | ○ |
| 12 | 43 | ○ | ○ | 360 | 326 | 14.6 | 33.5 | ○ | ○ |
| 13 | 41 | ○ | ○ | 341 | 307 | 14.1 | 27.6 | ○ | ○ |
| 14 | 42 | ○ | ○ | 362 | 330 | 14.6 | 31.6 | ○ | ○ |

TABLE 8-continued

| Forging number | Average grain size (μm) | Crystallized area ratio (%) | Average crystallized grain size (μm) | Mechanical characteristics: Tensile strength (MPa) | 0.2% Yield strength (MPa) | Elongation (%) | Charpy impact value (J/cm$^2$) | Rotating bending fatigue strength (MPa) | Stress corrosion cracking resistance |
|---|---|---|---|---|---|---|---|---|---|
| 15 | 41 | ○ | ○ | 344 | 311 | 16.4 | 28.3 | ○ | ○ |
| 16 | 41 | ○ | ○ | 340 | 302 | 11.4 | 25.1 | ○ | ○ |
| 17 | 41 | ○ | ○ | 355 | 324 | 15.9 | 29.6 | ○ | ○ |
| 18 | 41 | ○ | ○ | 346 | 313 | 12.7 | 26.0 | ○ | ○ |
| 19 | 41 | ○ | ○ | 348 | 314 | 16.2 | 31.3 | ○ | ○ |

TABLE 9

| Forging number | Average grain size (μm) | Crystallized area ratio (%) | Average crystallized grain size (μm) | Mechanical characteristics: Tensile strength (MPa) | 0.2% Yield strength (MPa) | Elongation (%) | Charpy impact value (J/cm$^2$) | Rotating bending fatigue strength (MPa) | Stress corrosion cracking resistance |
|---|---|---|---|---|---|---|---|---|---|
| 20 | Measurement impossible due to casting cracks | | | | | | | | |
| 21 | 509 | ○ | ○ | 315 | 286 | 15.3 | 28.6 | X | ○ |
| 22 | 40 | X | X | 355 | 320 | 12.1 | 12.8 | X | ○ |
| 23 | 438 | ○ | ○ | 306 | 280 | 14.6 | 27.7 | X | ○ |
| 24 | 38 | X | X | 335 | 304 | 12.6 | 13.1 | X | ○ |
| 25 | 462 | ○ | ○ | 308 | 280 | 4.5 | 12.8 | X | ○ |
| 26 | 40 | X | X | 345 | 311 | 13.4 | 14.4 | X | ○ |
| 27 | 42 | X | X | 341 | 308 | 12.8 | 12.9 | X | ○ |
| 28 | 810 | ○ | ○ | 294 | 259 | 12.4 | 24.9 | X | ○ |
| 29 | 578 | ○ | ○ | 298 | 268 | 18.8 | 26.4 | X | ○ |
| 30 | 84 | ○ | X | 318 | 286 | 13.9 | 16.7 | X | ○ |
| 31 | 563 | ○ | ○ | 317 | 286 | 15.8 | 29.5 | X | ○ |
| 32 | 40 | X | ○ | 303 | 276 | 13.7 | 19.8 | X | ○ |
| 33 | 155 | ○ | ○ | 312 | 280 | 16.1 | 27.6 | X | ○ |
| 34 | 41 | ○ | ○ | 317 | 289 | 14.2 | 24.2 | X | ○ |
| 35 | 41 | ○ | ○ | 301 | 280 | 8.9 | 18.0 | X | ○ |
| 36 | 41 | ○ | ○ | 309 | 281 | 15.9 | 29.6 | ○ | X |
| 37 | 41 | ○ | ○ | 308 | 284 | 9.2 | 19.2 | ○ | ○ |
| 38 | 41 | ○ | ○ | 320 | 287 | 25.8 | 30.3 | X | X |

As shown in Tables 8 and 9, manufacturing numbers 1 to 19 met all the requirements of the present invention, and therefore provided good evaluation results.

In contrast, manufacturing numbers 20 to 38 did not meet all the requirements of the present invention, and therefore did not provide good evaluation results.

Specifically, manufacturing number 20 exhibited casting cracks since the casting rate was high in the casting step. Accordingly, average grain size and other characteristics could not be measured.

In manufacturing number 21, the heating temperature in the homogenizing heat treatment step was higher than its upper limit, so that dispersed particles were coarsened, and its average grain size was determined unacceptable. In addition, its tensile strength, 0.2% yield strength, and rotating bending fatigue strength were determined unacceptable.

In manufacturing number 22, the heating temperature in the homogenizing heat treatment step was lower than the lower limit thereof, so that penetration of crystallized grains was insufficient, and the size of the crystallized grains therein was increased. Accordingly, its crystallized area ratio and average crystallized grain size were determined unacceptable. In addition, its Charpy impact value and rotating bending fatigue strength were determined unacceptable.

In manufacturing number 23, the heating time in the homogenizing heat treatment step was longer than its upper limit, so that the dispersed particles therein were coarsened, and its average grain size was determined unacceptable. In addition, its tensile strength, 0.2% yield strength, and rotating bending fatigue strength were determined unacceptable.

In manufacturing number 24, the heating time in the homogenizing heat treatment step was shorter than the lower limit thereof, so that penetration of crystallized grains was insufficient, and the size of the crystallized grains therein was increased. Accordingly, its crystallized area ratio and average crystallized grain size were determined unacceptable. In addition, its Charpy impact value and rotating bending fatigue strength were determined unacceptable.

In manufacturing number 25, the heating temperature in the heating step was higher than its upper limit, so that dispersed particles therein were coarsened and their density was lowered, whereby crystal grain refining effect was not obtained. As a result, its average grain size was determined unacceptable. In addition, its tensile strength, 0.2% yield strength, elongation, Charpy impact value, and rotating bending fatigue strength were determined unacceptable.

In manufacturing number 26, the heating temperature in the heating step was lower than the lower limit thereof, so that solution of the Fe-based crystallized grains did not proceed, and its crystallized area ratio and average crystallized grain size were determined unacceptable. In addition, its Charpy impact value and rotating bending fatigue strength were determined unacceptable.

In manufacturing number 27, the heating time in the heating step was lower than the lower limit thereof, so that solution of the Fe-based crystallized grains did not proceed, and its crystallized area ratio and average crystallized grain size were determined unacceptable. In addition, its Charpy impact value and rotating bending fatigue strength were determined unacceptable.

In manufacturing number 28, the forging end temperature in the forging step was lower than the lower limit thereof, so that recrystallization occurred to coarsen the crystal grains, and its average grain size was determined unacceptable. In addition, its tensile strength, 0.2% yield strength, and rotating bending fatigue strength were determined unacceptable.

In manufacturing number 29, the draft in the forging step was higher than its upper limit, so that the crystal grains were coarsened by recrystallization, and its average grain size was determined unacceptable. In addition, its tensile strength, 0.2% yield strength, and rotating bending fatigue strength were determined unacceptable.

In manufacturing number 30, the draft in the forging step was lower than the lower limit thereof, so that the size of the crystal grains could not be reduced to 50 μm, or crystallized grains could not be refined. Accordingly, its average grain size and its average crystallized grain size were determined unacceptable. In addition, its tensile strength, 0.2% yield strength, and rotating bending fatigue strength were determined unacceptable.

In manufacturing number 31, the heating temperature in the solution treatment step was higher than its upper limit, so that the crystal grains were coarsened, and its average grain size was determined unacceptable. In addition, its tensile strength, 0.2% yield strength, and rotating bending fatigue strength were determined unacceptable.

In manufacturing number 32, the heating temperature in the solution treatment step was lower than the lower limit thereof, so that solutionizing was insufficient, and its crystallized area ratio was determined unacceptable. In addition, its tensile strength, 0.2% yield strength, Charpy impact value, and rotating bending fatigue strength were determined unacceptable.

In manufacturing number 33, the heating time in the solution treatment step was higher than its upper limit, so that the crystal grains were coarsened, and its average grain size was determined unacceptable. In addition, its tensile strength and 0.2% yield strength were determined unacceptable.

In manufacturing number 34, the hardening temperature in the hardening step was higher than its upper limit, so that sufficient hardening was not performed, and the strength could not be sufficiently improved. Accordingly, its tensile strength, 0.2% yield strength, and rotating bending fatigue strength were determined unacceptable.

In manufacturing number 35, the heating temperature in the artificial aging step was higher than its upper limit, so that the aging treatment was overly performed, and its tensile strength, 0.2% yield strength and elongation were lowered and determined unacceptable. In addition, its Charpy impact value and rotating bending fatigue strength were determined unacceptable.

In manufacturing number 36, the heating temperature in the artificial aging step was lower than the lower limit thereof, so that its tensile strength and 0.2% yield strength were not sufficiently improved, and were determined unacceptable. In addition, its stress corrosion cracking resistance was determined unacceptable.

In manufacturing number 37, the heating time in the artificial aging step was higher than its upper limit, so that the aging treatment was overly performed. Therefore, its tensile strength, 0.2% yield strength and elongation were lowered and determined unacceptable. In addition, its Charpy impact value was determined unacceptable.

In manufacturing number 38, the heating time in the artificial aging step was shorter than the lower limit thereof, so that its 0.2% yield strength was not sufficiently improved, and was determined unacceptable. In addition, its rotating bending fatigue strength and stress corrosion cracking resistance were determined unacceptable.

The invention claimed is:

1. An aluminum alloy forging, comprising:

Si: not less than 0.4% by mass but not more than 1.5% by mass,

Fe: not less than 0.45% mass but not more than 1.0% by mass,

Cu: not more than 0.40% by mass,

Mg: not less than 0.8% by mass but not more than 1.3% by mass,

Ti: not less than 0.01% by mass but not more than 0.1% by mass,

Zn: not more than 0.05%, at least one member selected from the group consisting of Mn: no less than 0.01% by mass but not more than 1.0% by mass, Cr: not less than 0.1% by mass but not more than 0.4% by mass, and Zr: not less than 0.05% by mass but not more than 0.2% by mass, hydrogen: not more than 0.25 ml/100 g Al, and Al, wherein the aluminum alloy forging has an average grain size of 50 μm or lower, a crystallized area ratio of 3% or lower, and an average crystallized grain size of 8 μm or lower.

2. The aluminum alloy forging of claim 1, which comprises Fe: not less than 0.45% by mass but not more than 0.7% by mass.

3. The aluminum alloy forging of claim 1, further comprising at least one of C, Ni, Na, Ca, V, and Hf in a total amount of not more than 0.1% by mass.

4. The aluminum alloy forging of claim 1, further comprising B: not more than 300 ppm.

5. The aluminum alloy forging of claim 1, which has the average grain size of 45 μm or lower.

6. The aluminum alloy forging of claim 1, which has the average grain size of 40 μm or lower.

7. The aluminum alloy forging of claim 1, which has the crystallized area ratio of 2.5% or lower.

8. The aluminum alloy forging of claim 1, which has the crystallized area ratio of 2.0% or lower.

9. The aluminum alloy forging of claim 1, which has the average crystallized grain size of 6 μm or lower.

10. A method for manufacturing the aluminum alloy forging of claim 1, the method comprising:

casting, at a heating temperature of 710 to 810° C. and at a casting rate 230 to 330 m m/min an ingot of an aluminum alloy comprising:

Si: not less than 0.4% by mass but not more than 1.5% by mass,

Fe: not less than 0.45% by mass but not more than 1.0% by mass,

Cu: not more than 0.40% by mass,

Mg: not less than 0.8% by mass but not more than 1.3% by mass,

Ti: not less than 0.01% by mass but not more than 0.1% by mass,

Zn: not more than 0.05%, at least one member selected from the group consisting of Mn: not less than 0.01% by mass but not more than 1.0% by mass, Cr: not less than 0.1% by mass but not more than 0.4% by mass, and Zr: not less than 0.05% by mass not more than 0.2% by mass, hydrogen: not more than 0.25 ml/100 g Al, and Al;

subjecting the ingot to a homogenizing heat treatment at 420 to 560° C. for 2.5 to 8 hours;

heating the ingot which has been subjected to the homogenizing heat treatment at 470 to 545° C. for 0.5 hours or longer to obtain a heated ingot;

forging the heated ingot at a temperature of 330° C. or higher and at a draft of 50 to 95% after completion of the forging to obtain a forging in a predetermined shape;

subjecting the forging in a predetermined shape to a solution treatment at 480 to 580° C. for longer than 0 hours but not longer than 24 hours;

hardening the forging which has been subjected to the solution treatment at 75° C. or lower to obtain a hardened forging; and subjecting the hardened forging at 160 to 250° C. for 0.5 to 20 hours to artificial aging.

* * * * *